United States Patent [19]

Svoboda

[11] 4,299,404

[45] Nov. 10, 1981

[54] SKI BINDING PART

[75] Inventor: Josef Svoboda, Schwechat, Austria

[73] Assignee: TMC Corporation, Baar, Switzerland

[21] Appl. No.: 957,089

[22] Filed: Nov. 2, 1978

[30] Foreign Application Priority Data

Mar. 3, 1978 [AT] Austria ..... 1546/78

[51] Int. Cl.[3] ..... A63C 9/24

[52] U.S. Cl. ..... 280/634; 74/89.15

[58] Field of Search ..... 280/623, 633, 634; 64/29; 74/89.15

[56] References Cited

U.S. PATENT DOCUMENTS 2,561,136 7/1951 Richardson ..... 64/29

3,950,003 4/1976 Korger ..... 280/634 X 4,062,203 12/1977 Leonard et al. ..... 64/29

4,101,061 7/1978 Sage et al. ..... 64/29 X

*Primary Examiner*—Joseph F. Peters, Jr.

*Assistant Examiner*—Michael Mar

*Attorney, Agent, or Firm*—Blanchard, Flynn, Thiel, Boutell & Tanis

[57] ABSTRACT

A ski binding part with a sole holder for ski boots, which can be automatically adjusted to provide the proper hold-down force for different height ski boot soles or ski boot heels by a torque limiting coupling and a bolt which, when the ski binding is mounted on the ski, stands substantially perpendicular with respect to the upper side of the ski.

7 Claims, 13 Drawing Figures

SKI BINDING PART

FIELD OF THE INVENTION

The invention relates to ski binding parts, and in particular to those ski binding parts having a sole holder that is adjustable to fit ski boot soles of various thicknesses.

BACKGROUND OF THE INVENTION

In ski bindings which consist of a front jaw and of a heel holder, the function of safety is divided between these two ski binding parts, in that the front jaw is in general solely responsible for the lateral safety release and the heel holder for the forward fall. In the case of a twisting fall, the two ski binding parts become active depending on individual force vectors which are the components of a resultant, which resultant is the reaction force of an external force which is caused by the twisting fall. In the case of simple falls, there exists the danger of a jamming of the ski boot sole on the ski binding part which does not become active; in the case of a twisting fall, this danger is created for both ski binding parts.

It is already known to overcome such phenomena which endanger safety by pivotally supporting the holder which grips the ski boot sole or the ski boot heel about an additional axis which is independent from the swivel axis which is responsible for the safety release, and by holding the holder in position by means of spring force. This solution theoretically permits resilient holding of the ski boot sole or the ski boot heel, however the danger of jamming is not overcome through this, because the resiliency of the holder can generally be adjusted, so that a mechanic can adjust the sole holder resiliency too tightly. Then the aforementioned disadvantages also automatically occur in this kind of ski bindings.

A further disadvantage of the known constructions exists in that for the desired perfect function, not only an additional spring, but also a further swivel axis with the associated bearing parts is needed. Such constructions are described for example in German OS No. 1,909,392 and No. 1,943,973.

An object of the present invention, therefore, is to provide in the case of ski binding parts of the above-mentioned type, functionally safe solutions to the above-mentioned problems without the disadvantages of the known constructions. More specifically, the objects of the invention include:

1. To provide a ski binding part that will prevent overtightening of the sole holder onto the ski boot sole.
2. To provide a ski binding part, as aforesaid, which may be quickly, easily and exactly adjusted to engage ski boot soles of various thicknesses.
3. To provide a ski binding part, as aforesaid, which is simple in structure and inexpensive to manufacture, and may be incorporated in a conventional binding with a minimum of structural modifications.

SUMMARY OF THE INVENTION

The aforementioned objects are inventively attained by arranging between the sole holder and the adjustment bolt a coupling device, one part of which is connected to the sole holder and the other part of which is connected to the bolt. Because of the coupling, the bolt which is provided for operating the sole holder is effective only to a limited extent in the direction of tightening, namely, up to the limit of the transfer capability of the coupling, and is fully effective only in direction of the release, if constructed as a self-locking unit. In particular, as soon as the bolt tightens the sole holder past the torque transfer capability of the coupling, the driven coupling half slips or slides over the other coupling half, which is attached directly or indirectly to the sole holder, even though the mechanic tries to force the screw bolt to close the sole holder even more. It can be seen that, on the one hand, a jamming of the ski boot sole or the ski boot heel through overtightening is prevented, and on the other hand, an easy adjustment for different thicknesses of ski boot soles or heels is assured. It can also be seen that the inventive construction permits a very simple structure of the sole holder, because the conventional arrangements can be maintained and no structural parts are needed which would require a swinging of the sole holder about an additional axis.

A particularly advantageous embodiment of the invention is that in which the predetermined torque transfer threshold value can, if desired, be varied. In this manner the force which is permissible for holding down the ski boot sole or the ski boot heel can be determined easily and exactly in advance.

BRIEF DESCRIPTION OF THE DRAWINGS

Further advantages, details and inventive characteristics will now be described in connection with the drawings, which illustrate several exemplary embodiments.

In the drawings:

FIGS. 1 and 2 are associated views of a first exemplary embodiment of the invention in a front jaw, wherein FIG. 1 is a side view, partially in cross section, and FIG. 2 is a top view partially in cross section;

DETAILED DESCRIPTION

Figure 1:
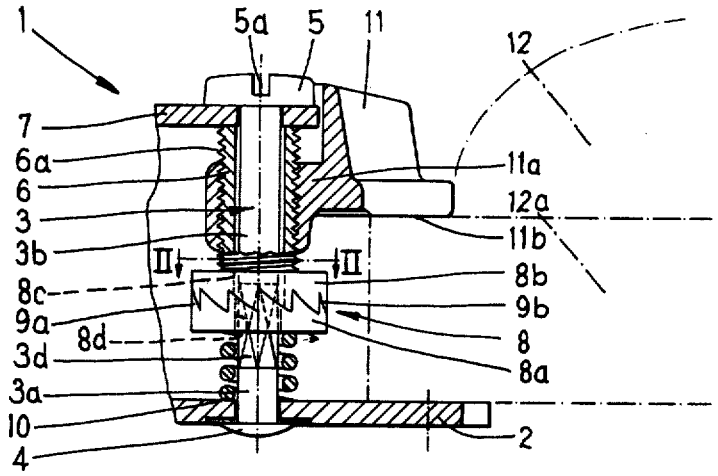

In the following description of the individual exemplary embodiments, structural parts of different embodiments which correspond with respect to both structure and function are identified by identical reference numerals, however structural parts having corresponding functions but differing in structure have identical reference numerals differentiated by a prime (') or by several primes (",''').

In the first exemplary embodiment (FIGS. 1 and 2), a ski binding part, here a front jaw, is identified as a whole by reference numeral 1. A bolt 3 is positioned perpendicularly with respect to a base plate 2 and is rotatably supported in the base plate 2, which base plate also supports the entire ski binding part 1 and is used to fasten it on a not-illustrated ski. The lower end of the bolt 3 extends downwardly through the base plate 2 and is riveted there, as at 4. The other end of the bolt 3 extends upwardly through a housing 7 of the ski binding part 1, constructed as a cover, and has a head 5 with a slot 5*a*. The lower part 3*a* of the bolt 3 adjacent the rivet 4 and the upper part 3*b* adjacent the head 5 have no threads. The central part 3*d* of the bolt 3 is constructed with a square cross section, on which is mounted one half 8*a* of a slip coupling 8. The coupling half 8*a* has a square opening 8*d* therethrough for engagement with the square section 3*d*, such that clutch half 8*a* is rotationally fixed with respect to the bolt 3, but is axially slidable along the square section 3*d* of bolt 3. The other coupling half 8*b* has an opening 8*c* sufficiently large to permit rotation about the square section 3*d* and with respect to coupling half 8*a*. The half 8*b* of the slip coupling 8 is also fixedly connected to one end of a sleeve 6, which is arranged substantially coaxially with respect to the bolt 3 and which is freely rotatable about the bolt 3. The other end of the sleeve 6 is butted against the inside surface of the housing 7. The sleeve 6 has a thread 6*a* which engages a threaded portion 11*a* of a sole holder 11. Both halves 8*a* and 8*b* of the slip clutch 8 have saw teeth 9*a* and 9*b* respectively, which, when the thread 6*a* of the sleeve 6 is right-handed, are constructed to be self-locking during relative clockwise rotation as viewed from the top, but freely running during relative counterclockwise rotation. This free running has a limit, however, in that the lower half 8*a* of the slip coupling 8 is urged upwardly by a spring 10. The spring 10 is, in the present exemplary embodiment, a helical spring encircling the lower part 3*a* of the bolt 3, one end of the spring 10 butting against the upper surface of the base plate 2, and the other end pressing upwardly on the bottom of coupling half 8*a*. The axial length of the square section 3*d* of the bolt 3 is dimensioned such that the teeth 9*a* of the lower coupling half 8*a* will disengage from the teeth 9*b* of the upper coupling half 8*b* if, as inventively provided, the braking torque at the upper coupling half 8*b* exceeds the operating torque at the lower coupling half 8*a*, whereby the latter slides downwardly along the teeth 9*b* of the former, against the force of the spring 10 and toward the base plate 2. Moreover, by rotating the bolt 3 in a counterclockwise direction, the sole holder 11 will be lowered by the thread 6*a* of the sleeve 6 until it encounters the top of coupling half 8*b*. Upon rotation of the bolt 3 in a clockwise direction, the sole holder 11 can be raised until it encounters the lid of the housing 7.

If the ski binding part 1 is now supposed to be adjusted to the ski boot sole 12*a* of a ski boot 12, then first the head 5 is rotated clockwise by means of a tool placed into the slot 5*a*, for example a screwdriver or a coin, until the lower side 11*b* of the sole holder 11 is raised above the ski boot sole 12*a*. Then the ski boot 12 is introduced into the ski binding part 1, after which the bolt 3 is rotated in a counterclockwise direction so long as the force of the spring 10 actively holds together the two coupling halves 8*a* and 8*b*. Upon reaching a predetermined hold-down force on the boot sole, the spring 10 yields and the two halves 8*a* and 8*b* of the slip coupling 8 slide one over the other, so that an undesired pinching of the ski boot sole 12*a* by the sole holder 11 cannot occur.

In other words, when the boot sole 12*a* is not engaging the sole holder 11, spring 10 will maintain coupling halves 8*a* and 8*b* in a driving relation, and rotation of bolt 5 will cause coupling half 8*a* to drive coupling half 8*b* and sleeve 6, whereby the sole holder 11 will be moved upwardly or downwardly, within the limits described above, through the threaded engagement of the sole holder 11 with the threads 6*a* of the sleeve 6. When, however, the boot sole 12*a* is inserted beneath the raised sole holder 11, and bolt 5 is rotated so as to move sole holder 11 downwardly, downward movement will occur until the upward resistance of the ski boot sole 12*a* against the sole holder 11 acts through the threads 6*c* on sleeve 6 to increase the torque that coupling 8*a* must apply to 8*b* to effect further downward movement. A threshold point will eventually be reached at which the torque required to turn coupling half 8*b* will exceed the torque applied to coupling half 8*a* to force spring 10 downwardly, so as to permit coupling half 8*a* to slip across the teeth 9*b* of coupling half 8*b* in a tooth-by-tooth, ratchetlike manner.

Figure 2:
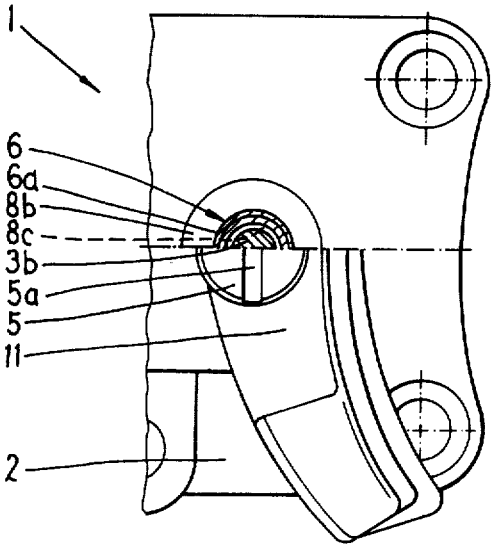
Figure 3:
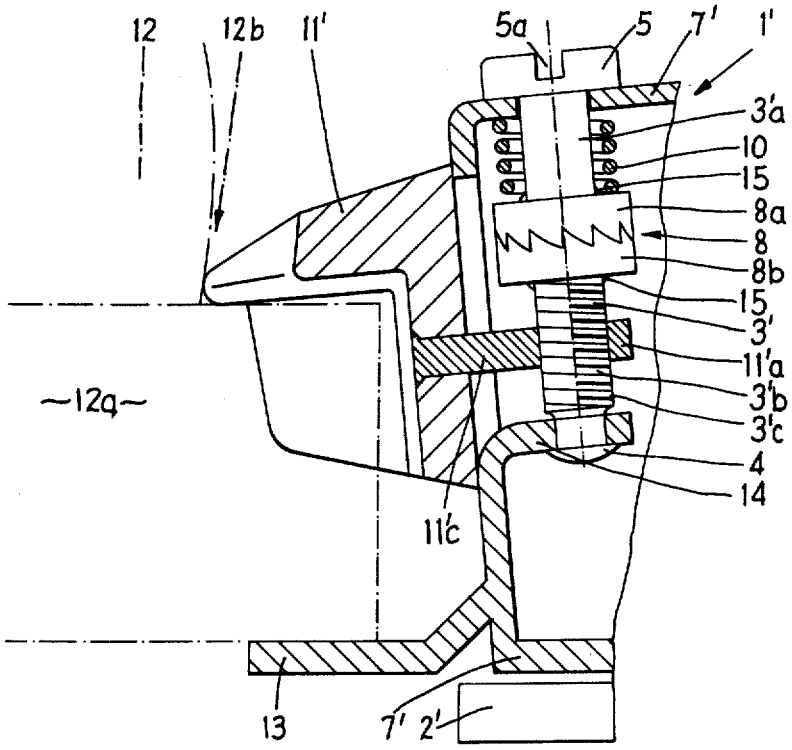
FIG. 3 is a cross-sectional side view of a second exemplary embodiment of the invention in a heel holder.

In the exemplary embodiment according to FIG. 3, a ski binding part 1' can be recognized, in the present case a heel holder, which can be used, for example, with the ski binding part 1 according to FIGS. 1 and 2 to form a complete ski binding. The structure of the inventive part of the sole holder is similar to that in the first exemplary embodiment, with the difference that the ski boot heel 12*b* of the ski boot 12 is now received between a plate 13 of the housing 7' and the sole holder 11'. The rotatable bolt 3' is riveted to a flange 14 of the housing 7'. Here, the bolt 3' has two independent parts 3'*a* and 3'*b*, and part 3'*b* itself has the thread 3'*c* which is needed for operating the sole holder 11'. The part of the bolt 3' which is provided with the thread 3*c* is adjacent the rivet 4. The spring 10 is arranged in the area of the screw bolt 3' adjacent the head 5, wound around the upper, thread-free part 3*a* of the screw bolt 3'. The structure and arrangement of the slip coupling 8 corresponds substantially with that already described. Only the type of fastening of the two halves 8*a*, 8*b* of the slip coupling 8 to the bolt 3' is different from the first exemplary embodiment, in that these are connected to the respective individual bolt parts 3*a* and 3*b* through welding seams 15. The sole holder 11' has an internally threaded hole in an extension 11*c*, which thread is engaged with the thread 3'*c* of the bolt part 3'*b*. Adjustment of the sole holder 11' can be done in the already-described manner, whereby the cooperation of slip coupling 8 and spring 10 is similar to the first exemplary embodiment. To fasten the ski binding part 1' on a not-illustrated ski, the indicated base plate 2' is used.

Figure 3A:
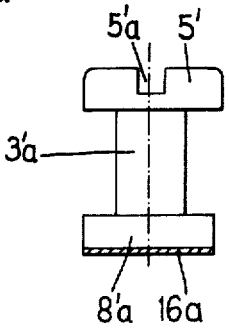
FIGS. 3*a* and 3*b* illustrate modified details of FIG. 3.
Figure 3B:
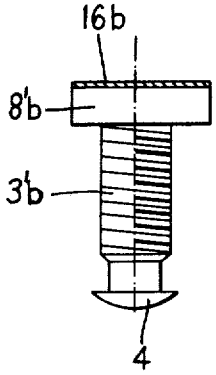

FIGS. 3*a* and 3*b* illustrate a further construction of a slip coupling 8', wherein on each of the two bolt parts 3'*a* and 3'*b*, there is a friction coupling half 8'*a* or 8'*b*, preferably held on with a press fit, and wherein the coupling action is produced or caused by interaction of friction surfaces 16*a* and 16*b*. Such friction materials are known in couplings, brakes or the like, whereby the interaction of such friction elements can also be assumed to be known. The further structure of the ski binding part 1' corresponds with what has already been described. To be complete it is remarked that to prevent unintentional rotation of an individual coupling part 8'*a* or 8'*b*. Relative to the shaft of the respective individual bolt part 3'*a* or 3'*b*, it is possible to provide between these respective structural parts a shoulder, key, or the like which extends in a radial direction and which lockingly engages a congruent recess in the other structural part. By suitably selecting the friction surfaces 16*a* and 16*b*, the degree of hold-down force can be predetermined. Thus, after installation, the friction action cannot generally be inadvertently changed, except by reconstruction in the factory.

Figure 4:
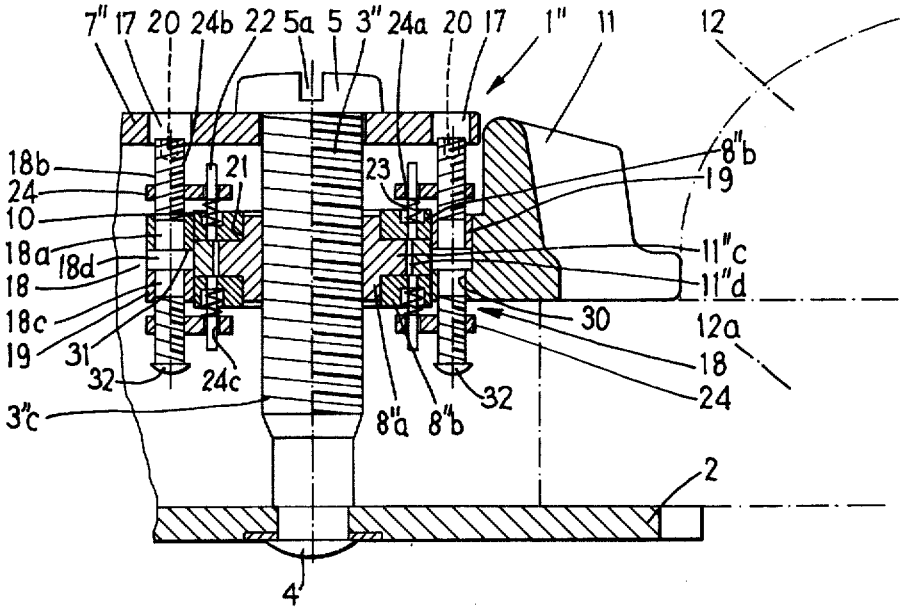
FIGS. 4 and 5 illustrate a third exemplary embodiment in a manner similar to FIGS. 1 and 2.
Figure 5:
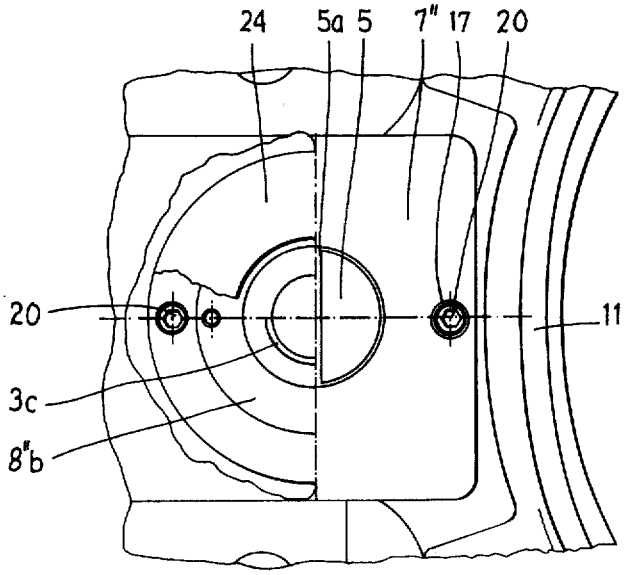

In the embodiment according to FIGS. 4 and 5, a ski binding part 1'' illustrates a further exemplary embodiment of a front jaw according to the invention. A bolt 3'' with a thread 3''c, which extends across the entire adjustment range of the sole holder 11'', is arranged on the base plate 2 and the housing 7'' in a manner similar to that already described. The housing 7'' also has, in the present case, two openings 17, each of which is aligned with a further bolt 18. The individual bolts 18 each have a center, thread-free area 18a, and two areas 18b and 18c provided with threads which operationally oppose each other. The thread 18b, which is the upper one adjacent to the lid of the housing 7'', is preferably a right-hand thread and the thread 18c adjacent the base plate 2 a left-hand thread. The thread-free, center area 18a of each bolt 18 has a collar 18d or the like, through which it is supported rotatably in relationship to the sole holder 11''. To simplify installation, it is preferable, when the collar 18d rests in one direction on a shoulder-like constriction 31 of an opening 30 of the sole holder 11'', which opening 30 serves to receive the bolt 18, if the other side of the collar 18d rests against a sleeve 19 or the like closing off the space between the screw bolt 18 and the sole holder 11''. The end of each screw bolt 18 which faces the housing 7'' has a hexagonal-recess 20 into which an appropriate tool may be inserted for operating the bolt 18. The opposite end of each bolt 18 has a limit stop 32 which is not described in detail.

The extension 11''c of the sole holder 11'', through which the sole holder 11'' is elevationally adjustable in relation to the screw bolt 3'', has an opening 11''d therethrough, the diameter of which is considerably greater than that of the screw bolt 3''. One part 8''a of a friction clutch 8'' is arranged in this opening 11''d, and threadedly engages the threads 3''c of bolt 3''. The other part of the friction clutch 8'' is formed by several, in the present example two washer-shaped inserts 8''b (FIG. 5) arranged in recesses 21, which recesses 21 are each constructed in the part 8''a of the friction clutch 8'' and in the extension 11''c of the sole holder 11''. Two substantially vertically positioned pins 22 are fixedly held in each insert 8''b, each pin 22 having a helical spring 10'' wound around it, which spring 10'' is arranged in a receiving opening 23 of the insert 8''b and is supported with one end on the bottom of said receiving opening 23 and with its other end on a washer-shaped disk 24 (FIG. 5). As a whole, two disks 24 are provided, each with two openings 24c and two threaded tapholes 24b, which in turn are each associated respectively with a pin 22 and a threaded part 18b or 18c of the bolts 18. Accordingly, rotation of the bolts 18 will act through the right-hand and left-hand threads at 18b and 18c to increase or reduce the vertical distance between the two disks 24, thereby changing the tension on the springs 10''. By changing the tension of the springs 10'', the friction between the center part 8''a and the individual inserts 8''b can be increased or reduced, through which in turn the predetermined clamping force of the sole holder 11'' in relationship to the ski boot sole 12a of the ski boot 12 will be higher or lower. Further structure of the ski binding part 1'' and its operation correspond substantially with what has already been described. The only difference in the operation is that here there is no slip coupling loaded by the spring, but rather the friction clutch parts, which in themselves effect the coupling action. Thus, the effect corresponds approximately with the embodiment according to FIGS. 3a and 3b.

Figure 6:
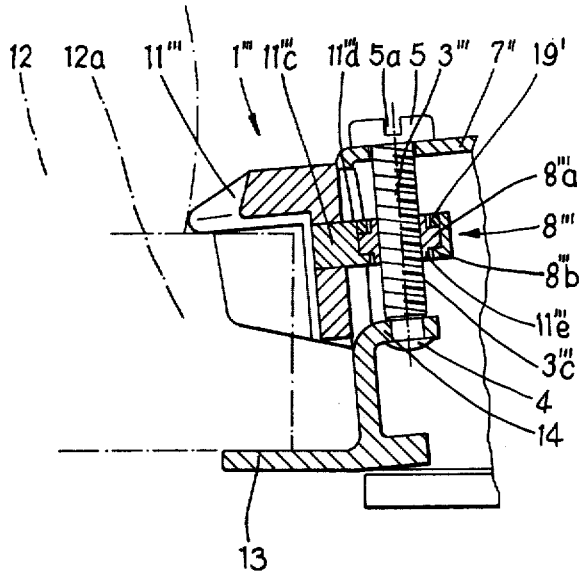
FIG. 6 illustrates a further exemplary embodiment for a sole holder in a heel holder, and FIGS. 6*a*, 6*b* and 6*c* on the one hand and FIGS. 6*d*, 6*e* on the other hand are associated views of details of the embodiment according to FIG. 6.
Figure 6A:
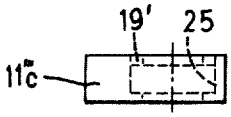
Figure 6C:
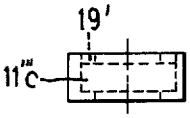
Figure 6D:
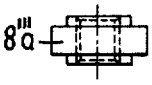
Figure 6B:
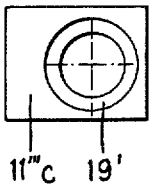
Figure 6E:
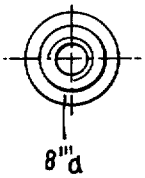

In the exemplary embodiment according to FIGS. 6 to 6e, the ski binding part 1''' is in structure similar to the exemplary embodiment according to FIG. 3, with the primary difference that, like the embodiment according to FIGS. 4 and 5, a friction coupling 8''' is provided. The difference between it and the embodiment according to FIGS. 4 and 5 consists of the friction coupling 8''' having constant friction values, such that it cannot be regulated. The friction coupling 8'' consists of a recess 25 (FIG. 6a) in the extension 11'''c of the sole holder 11''', in which is rotatably received a central coupling part 8'''a (FIG. 6d). The surfaces of the recess 25 and coupling part 8'''a engage each other in a manner providing the desired constant frictional characteristic. Except for the structure of the extension 11'''c of the sole holder 11''', which grips around the center friction coupling part 8'''a, and the bolt 3''' consisting of a single structural part having threads 3'''c from the head 5 to the rivet 4, the structure of the ski binding part 1''' equals the ski binding part 1' according to FIG. 3. Details of the friction clutch 8''' can be taken on the one hand from FIGS. 6a to 6c and on the other hand from FIGS. 6d and 6e, wherein the first-mentioned figures illustrate in associated views the structure of the extension 11'''c and the two last figures the structure of the center part 8'''a, also in associated views. The center part 8'''a is a nut which is engaged on the thread 3'''c of the bolt 3''', such that upon rotation of the bolt 3''', the sole holder 11''' is carried along in a downward direction toward the ski boot heel 12b of the ski boot 12 until the friction between the center part 8'''a and the congruent area of the extension 11'''c of the sole holder 11''' is less than the resistance applied by the ski boot heel 12b onto the sole holder 11'''. When this limit is reached, the center part 8'''a rotates with the screw bolt 3''', without carrying the sole holder 11''' further toward the plate 13.

For the purpose of a simple assembly, the recess 25 in the extension 11'''c which serves to receive the center part 8'''a can be closed off with a sleeve 19', similarly to the embodiment according to FIGS. 4 and 5.

The invention is not limited to the illustrated exemplary embodiments. Further modifications are conceivable without leaving the scope of the claims. Thus, in particular, neither the form nor the type of the coupling elements is limited to the illustrated embodiments. For example, one can enlarge the friction surfaces through a lamellalike construction of the coupling parts. It is also conceivable to use different coupling parts in the front jaw and in the heel holder. Furthermore, the various embodiments of front jaws and heel holders can be combined among one another.

The embodiments of the invention in which an exclusive property or privilege is claimed are defined as follows:

1. A ski binding part for use in holding a ski boot onto a ski, comprising:

a frame;

a sole holder adapted to engage the upper surface of the sole of said ski boot; and adjustment means mounted on said frame for effecting a movement of said sole holder relative to said frame and said upper surface of said sole of said ski boot, said adjustment means comprising means defining an internally threaded hole in said sole holder, an elongated externally threaded bolt threadedly engaged with said threads in said hole so that a rotation of said bolt will effect a movement of said sole holder along the length of said bolt, and slip coupling means having an input member and an output member, said output member being connected to said externally threaded bolt, said input member having tool engaging means thereon to facilitate a manual driving rotation of said input member, said slip coupling means further having means for effecting a positive coupling of said input member to said output member and a consequent rotary drive of said output member and said bolt and a movement of said sole holder freely along the length of said bolt until said sole holder engages said upper surface of said sole of said ski boot whereupon a continued driven rotation of said output member by said input member will be resisted by said sole of said bolt and said input member will rotate relative to said output member to thereby control the force by which said sole holder engages said upper surface of said sole.

2. The ski binding part according to claim 1, wherein said slip coupling means has saw teeth shaped teeth thereon.

3. The ski binding part according to claim 2, wherein said input member includes a thread-free, square cross-sectional part and a toothed member reciprocally movable on said square cross-sectioned part against the force of a spring in the longitudinal direction of said bolt a distance greater than the tooth depth of said saw teeth of said slip coupling means.

4. The ski binding part according to claim 3, wherein said externally threaded bolt is a hollow sleeve arranged substantially coaxially to said input member, and has an opening through which it is freely rotatable about said square cross sectioned part, said sleeve being provided with said external thread which engages said internally threaded portion of said sole holder.

5. The ski binding part according to claim 4, wherein said externally threaded bolt is a hollow sleeve fixedly connected to said output member and is slidably mounted on said thread-free part of said bolt, one end of said sleeve being located adjacent said tool receiving means on said input member, and wherein said means for effecting a positive coupling of said input and output members includes a spring for urging said input and output members together.

6. The ski binding part according to claim 1, wherein said slip coupling means is a disk-like coupling having flat friction surface means thereon.

7. The ski binding part according to claim 6, wherein said friction surface means consist of a material with high friction characteristics.

* * * * *